United States Patent [19]

Eke

[11] Patent Number: 4,874,914

[45] Date of Patent: Oct. 17, 1989

[54] MICROWAVE OVENS AND METHODS OF DEFROSTING FOOD THEREIN

[75] Inventor: Kenneth I Eke, Woldingham, England

[73] Assignee: Microwave Ovens Limited, Shirley, England

[21] Appl. No.: 301,464

[22] Filed: Jan. 26, 1989

[30] Foreign Application Priority Data

Feb. 5, 1988 [GB] United Kingdom ..... 8802575

[51] Int. Cl.[4] ..... H05B 6/68

[52] U.S. Cl. ..... 219/10.55 M; 219/10.55 B; 99/325; 426/243; 426/524

[58] Field of Search ..... 219/10.55 B, 10.55 R, 219/10.55 E, 10.55 M; 426/243, 523, 524, 234; 99/325, 451, DIG. 14

[56] References Cited

U.S. PATENT DOCUMENTS 3,470,942 10/1969 Fukada et al. ..... 219/10.55 B
4,097,707 6/1978 Kobayashi et al. ..... 219/10.55 B
4,255,639 3/1981 Kawabata et al. ..... 219/10.55 B
4,453,066 6/1984 Mori ..... 219/10.55 M
4,520,251 5/1985 Yokozeki ..... 219/10.55 M
4,525,615 6/1985 Wyland ..... 219/10.55 M
4,647,746 3/1987 Eke ..... 219/10.55 MX
4,661,670 4/1987 Eke ..... 219/10.55 EX

FOREIGN PATENT DOCUMENTS 2127658 4/1984 United Kingdom .

*Primary Examiner*—Philip H. Leung
*Attorney, Agent, or Firm*—Penrose L. Albright

[57] ABSTRACT

A microwave oven defrosts a food item by subjecting the food item to a first defrosting stage during which a flow of air is forced through the oven cavity by a fan, and microwave power is simultaneously delivered to the cavity, ceasing the first stage when the temperature of the air flow reaches a threshold value and subjecting the food item to a second defrosting stage during which the air flow is maintained continuously and the microwave power is pulsed in accordance with a pre-set program.

14 Claims, 6 Drawing Sheets

ONE TOUCH DEFROST

MICROWAVE OVENS AND METHODS OF DEFROSTING FOOD THEREIN

FIELD OF THE INVENTION

This invention relates to microwave ovens and to methods of defrosting food in microwave ovens.

BACKGROUND TO THE INVENTION

Conventional microwave ovens have a defrosting facility which works either by delivering microwave power to the oven cavity for a time duration set by the user or for a fixed time duration, in the latter case the user performing repeated defrosting operations for larger food items. The invention aims to provide a microwave oven, and a method of defrosting, in which the user merely needs to choose the defrosting function, after which follows a defrosting program dependent on the size of food item being defrosted.

SUMMARY OF THE INVENTION

According to one aspect of the invention a method of defrosting a frozen food item in a microwave oven comprises placing the food item in a cavity of the oven, subjecting the food item to a first defrosting stage during which a recirculating flow of air is forced through the cavity and microwave power is simultaneously delivered to the cavity, monitoring the temperature of the air flow and timing the defrosting process from the commencement of the first stage, ceasing the first stage when the temperature of the air flow reaches a threshold value, and subjecting the food item to a second defrosting stage having a duration related to the duration of the first stage, during the second stage the flow of air being maintained continuously and the microwave power being pulsed.

According to another aspect of the invention a microwave oven has a defrosting facility, a cavity, a fan for forcing air through the cavity, a magnetron for delivering microwave power to the cavity, a temperature sensor for sensing the temperature of the forced air flow, a timer for timing defrosting, and a microprocessor responsive to the temperature sensor and the timer for controlling the fan and the magnetron, selection of the defrosting facility on the oven being operative to defrost a food item placed in the cavity by subjecting the food item to a first defrosting stage during which a recirculating flow of air is forced through the cavity by the fan and microwave power is simultaneously delivered to the cavity, ceasing the first stage when the temperature of the air flow reaches a threshold value, and subjecting the food item to a second defrosting stage having a duration related to the duration of the first stage, during the second stage the flow of air being maintained continuously and the microwave power being pulsed.

Preferably the threshold temperature compensates for varying ambient temperature, the higher the ambient temperature the higher the threshold temperature. The threshold temperature may be derived by noting the air temperature at a predetermined time after commencement of defrosting, and then adding to the noted temperature a compensating temperature related to the ambient temperature. The ambient temperature is preferably detected by a thermocouple arranged adjacent where the air enters the cavity, the microprocessor having stored therein a characteristic relating compensating temperature and ambient temperature.

The duration of the second stage is preferably derived by reference to a characteristic which is stored in a microprocessor which controls operation of the oven and which relates the duration of the second stage to the time at which the threshold temperature is reached.

The second stage is preferably divided into alternate periods of no microwave power and predetermined magnitudes of microwave power, in accordance with a preset program which has a predetermined number of periods each of which has a time duration which is a preset proportion of the total duration of the second stage.

BRIEF DESCRIPTION OF THE DRAWINGS

A microwave oven forming a preferred embodiment of the invention, together with a method of defrosting, will now be described by way of example with reference to the accompanying drawings, in which.

DESCRIPTION OF THE PREFERRED EMBODIMENTS

Figure 1:
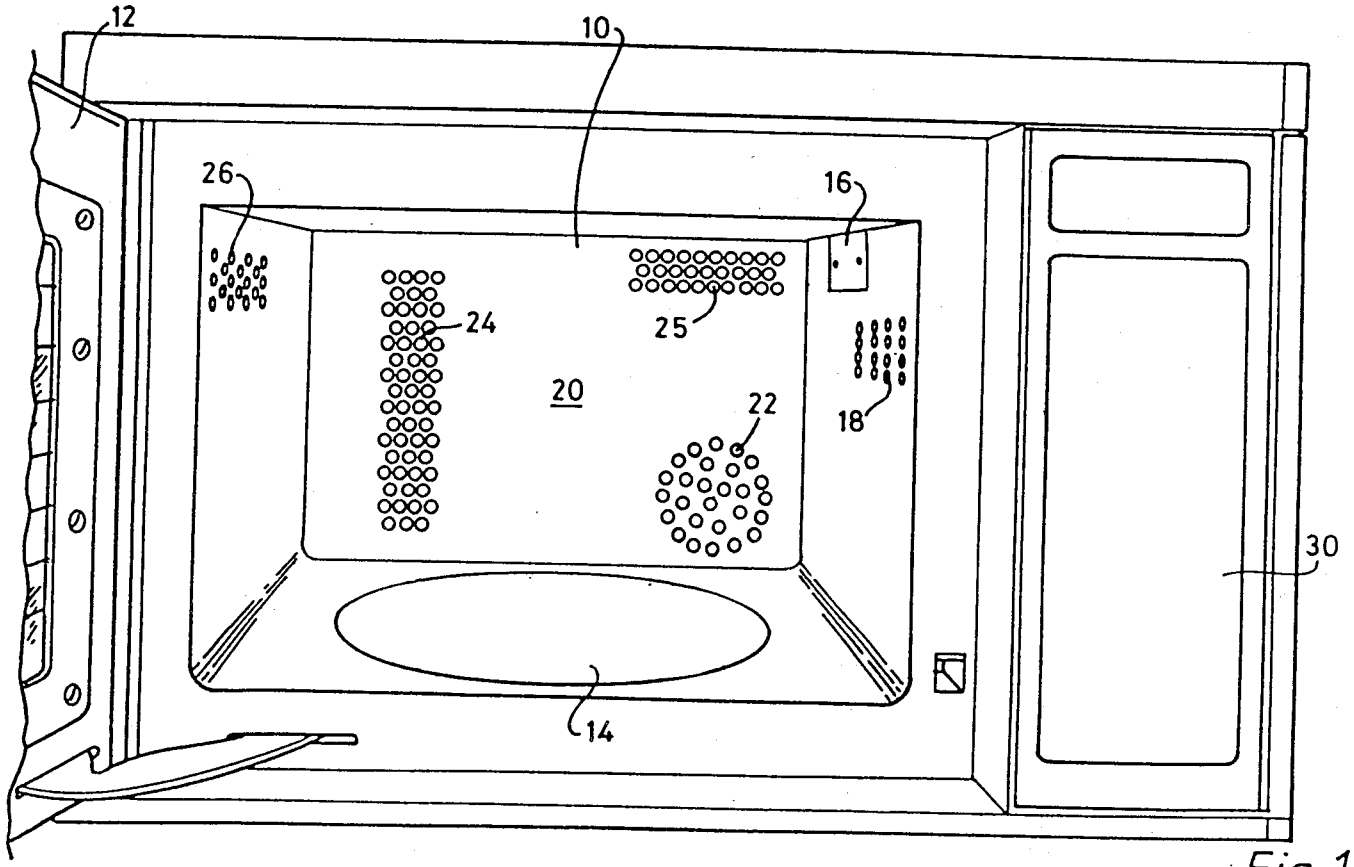
FIG. 1 is a front perspective view of the oven with an oven door open.

The oven is similar in construction and in circuit configuration to the ovens disclosed in the applicants' UK Patent Specifications Nos. 2127658A and 2137860A. In particular, the oven has a food-receiving cavity 10 which is closable by a hinged front door 12 and in the base of which is located a rotatable turntable 14. A magnetron (not shown) delivers microwave power to the cavity through an inlet 16. Cooling air from a magnetron blower fan enters the cavity through a perforated inlet 18 when a damper (not shown) is open. During defrosting, the damper is closed to prevent the air from the magnetron blower fan entering the cavity. The rear panel 20 of the cavity has a perforated outlet aperture 22 and a perforated inlet aperture 24, these two apertures respectively serving for the exit and entry of forced air to the cavity. The cavity has a further vent 25, a perforated area 26 which is illuminated, and the front of the casing of the oven has a control panel 30 including a touch pad for selecting defrosting.

Figure 2:
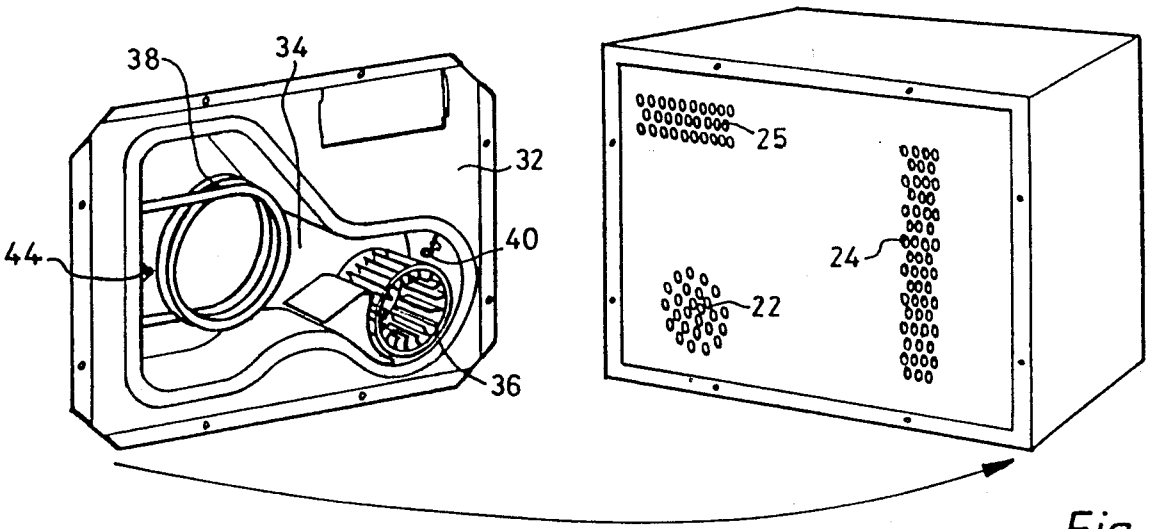
FIG. 2 shows the rear of the oven with a rear panel removed to show a rear compartment of the oven.
Figure 3:
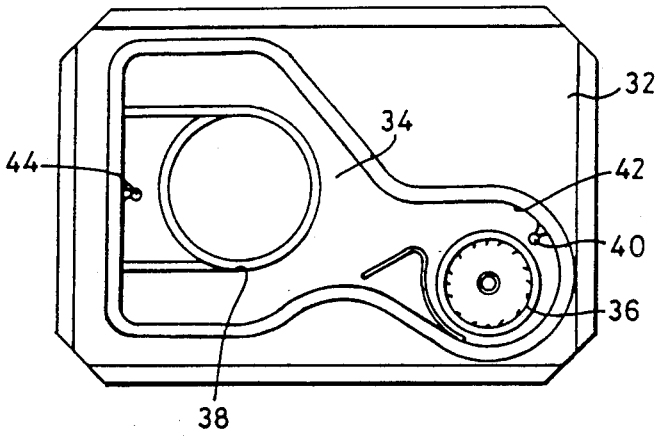
FIG. 3 is an elevation showing the casing and associated elements defining the rear compartment; process.

Referring to FIGS. 2 and 3, the rear of the oven has a casing 32 shaped to provide a rear compartment 34 through which air passes behind the panel 20. Within the compartment 34 are located a fan 36, disposed behind the outlet aperture 22, and an electrical resistance heating element 38, disposed behind the inlet aperture 24. The fan 36 is rotatable about a horizontal axis and has around its periphery a plurality of impeller blades which draw air from the cavity 10, through the outlet aperture 22, and thence force the air past the electrical resistance heating element 38, before redirecting the air back into the cavity 10 through the inlet aperture 24. During defrosting, the heating element 38 remains deenergised but the fan 36 is energised to recirculate air through the cavity 10 and the compartment 34 throughout the defrosting process.

A temperature sensor in the form of a thermocouple 40 is located in the compartment 34 at a position spaced midway between the outer periphery of the blades of the fan 36 and the adjacent wall 42 defining the peripheral margin of the rear compartment in this region. It will be seen from FIG. 3 that the thermocouple 40 is located at an angle of about 45° from a vertical line passing through the rotational axis of the fan 36. A further thermocouple 44 is located in a conventional position just downstream of the electrical resistance heating element 38. Signals from the two thermocouples 40, 44 provide an accurate indication of defrosting progress. Variations of temperature with time, as detected by the two thermocouples 40, 44, are used by the microprocessor of the oven in order to control the application of the microwave power during defrosting, in a manner now to be described.

To defrost a frozen food item, the user puts the item on a splash trivet resting on the turntable 14, closes the oven door 12, selects "Auto Defrost" (50, FIG. 8) by touching the appropriate key on the control panel 30, and then touches the "start" key (52, FIG. 8) on the control panel 30. The selection of the defrost mode causes the damper to be closed (to prevent air from the magnetron blower fan reaching the cavity), the fan 36 to be energised, the turntable 14 to be energised and the magnetron to be energised to deliver continuous microwave power to the cavity 10. This is shown by block 54 in FIG. 8. A timer commences to time the defrosting process (56, FIG. 8).

Figure 4:
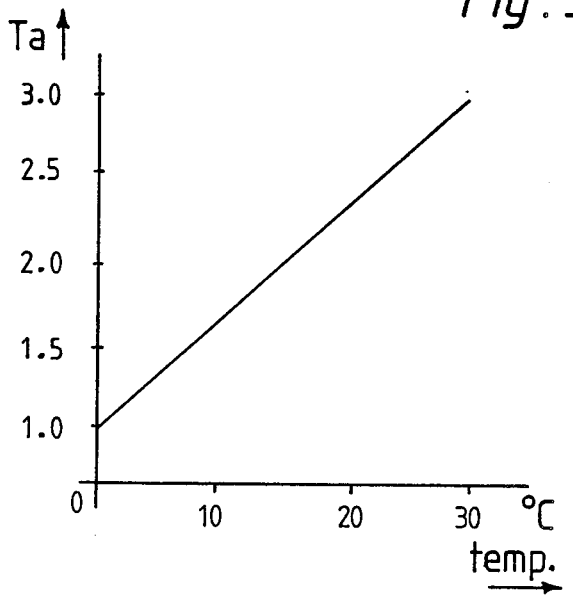
FIGS. 4–6 are graphs of the characteristics stored in the microprocessor of the oven.

At the commencement of defrosting, the thermocouple 44 records temperature, and the microprocessor determines the value of a compensating temperature $T_a$ (58, FIG. 8) by reference to the characteristic shown in FIG. 4. This characteristic is stored in the microprocessor and relates values of temperature detected by the thermocouple 44 at the commencement of defrosting to values of compensating temperature $T_a$.

Figure 8:
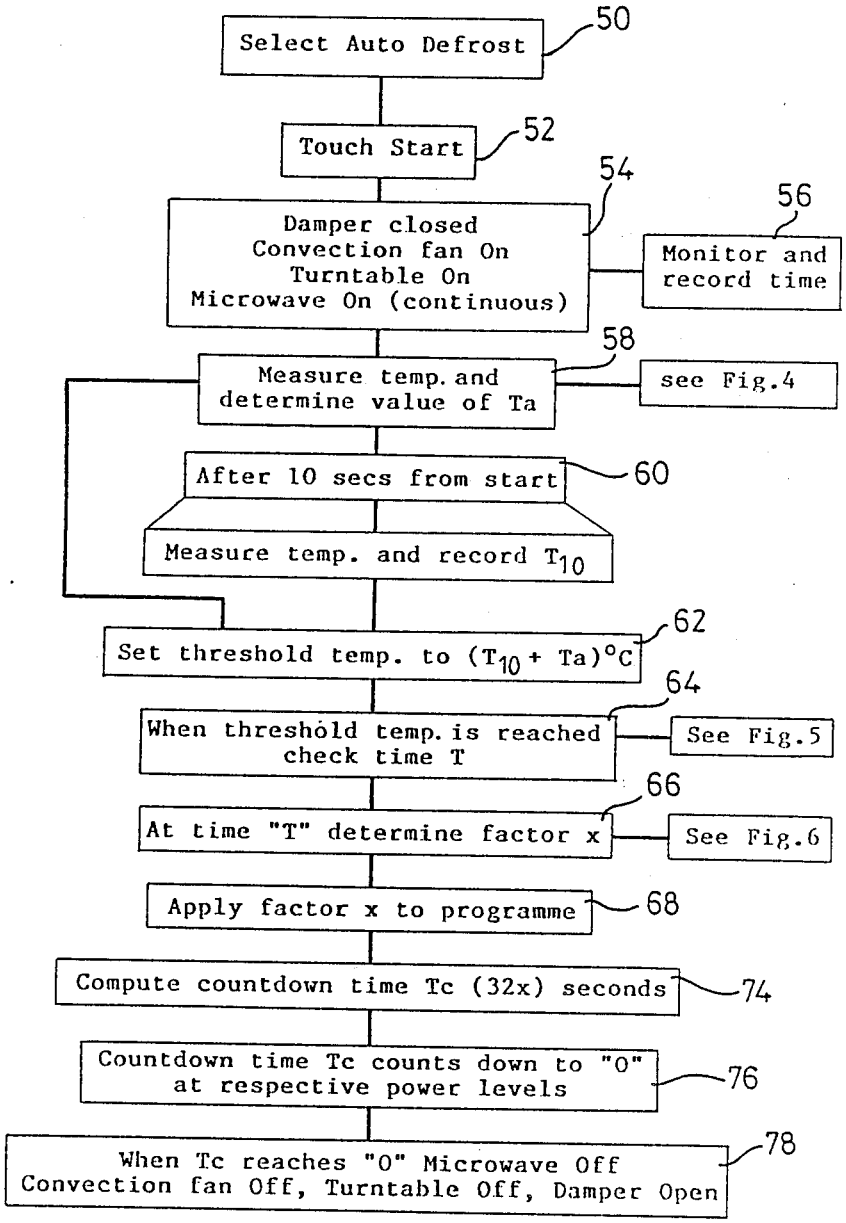
FIG. 8 is a flow chart.

At a predetermined time of 10 secs from the commencement of defrosting, the temperature detected by the thermocouple 40 is noted to provide a noted temperature $T_{10}$, as indicated at 60 in FIG. 8. A threshold temperature is then computed by adding the compensating temperature $T_a$ to the noted temperature $T_{10}$, as indicated at 62.

Figure 5:
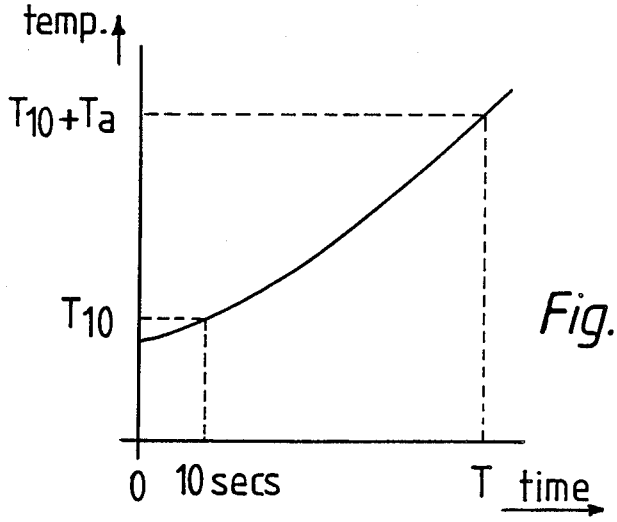
Figure 6:
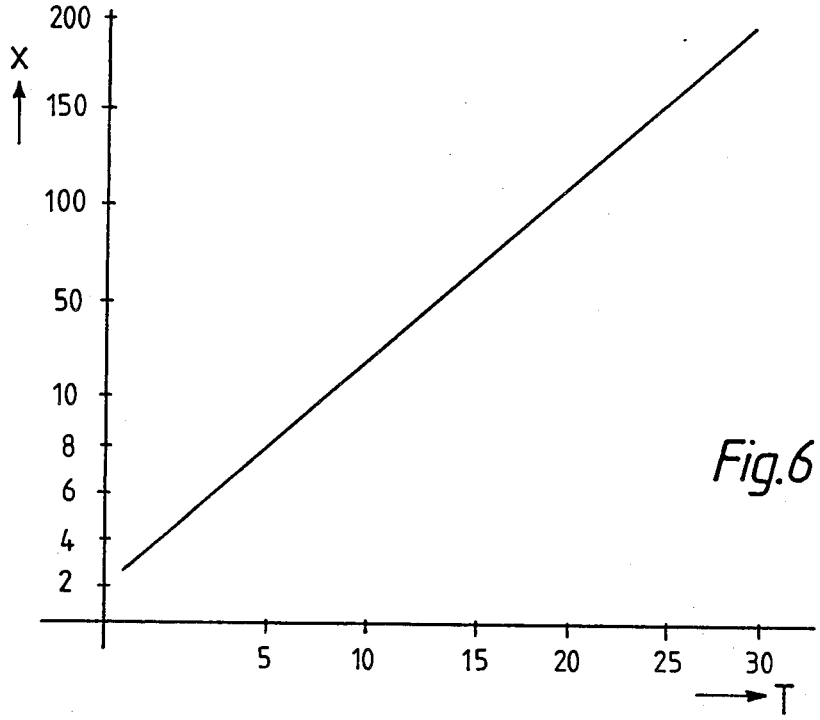

When the threshold temperature ($T_{10}+T_a$) is reached by the thermocouple 40, the corresponding time T is noted, as indicated graphically in FIG. 5, and as indicated at 64 in FIG. 8. At time T, a factor x is then determined by reference to the stored characteristic of FIG. 6 which relates values of T to values of x.

Having determined the factor x (66, FIG. 8), the defrosting process commences its second stage during which the fan 36 remains energised but the magnetron is pulsed for the time durations and at the respective output power levels shown in the Table below:

| Time (seconds) from commencement of second defrosting stage | Output power (watts) of magnetron |
|---|---|
| 8x | 0 |
| 5x | 90 |
| 3x | 0 |
| 2x | 250 |
| 8x | 0 |
| 4x | 90 |

-continued

| Time (seconds) from commencement of second defrosting stage | Output power (watts) of magnetron |
|---|---|
| 2x | 0 |

This pulsed operation of the magnetron has been found empirically to apply the correct amount of power, with the appropriate intervening standing periods with zero power, for effective defrosting without undue warming of extremities, such as the legs of poultry. It will be appreciated that the total duration of the second defrosting stage is directly proportional to the factor x which is determined in dependence upon the factor T, which in turn depends on the nature and size of the food item being defrosted and on ambient temperature. Reference 68 in FIG. 8 represents the application of factor x to the programmed second stage.

The second stage may have a different sequence for different values of x (indicating different types of food, for example red meats as distinct from white meats) but it is thought that a second stage such as that detailed above should be applicable to all foods.

Figure 7:
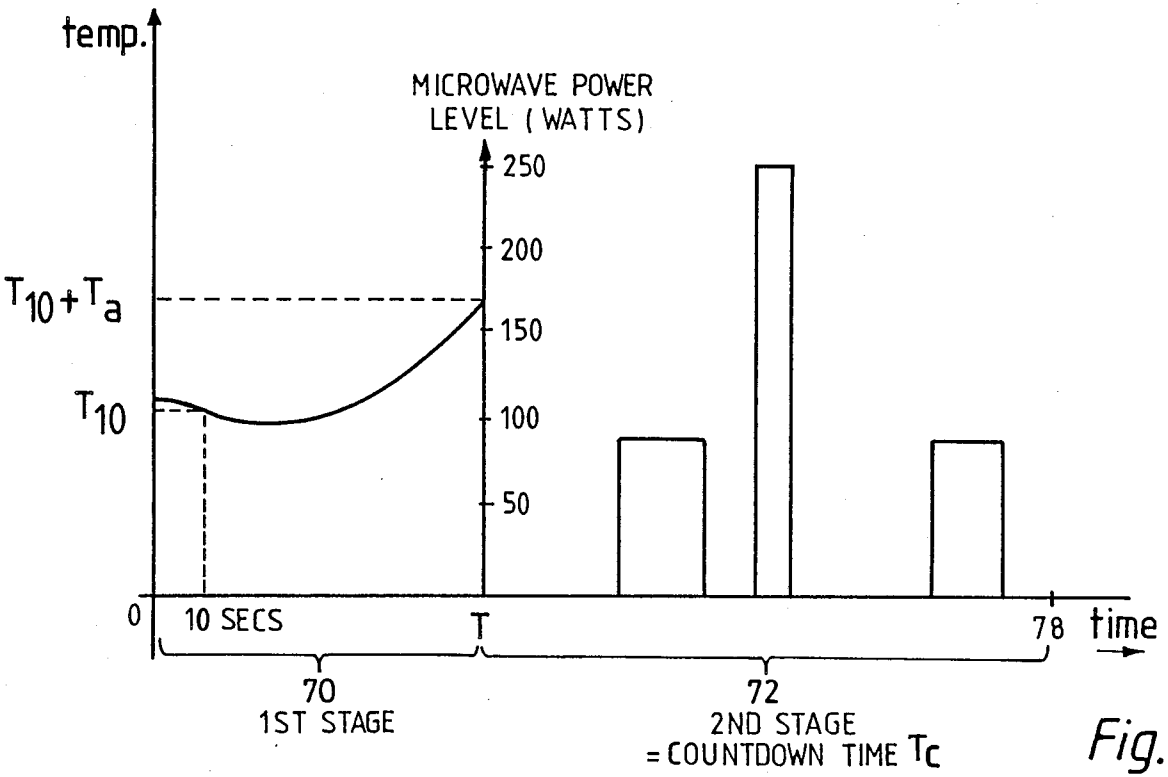
FIG. 7 is graph portraying the complete two-stage defrosting.

FIG. 7 represents graphically the complete defrosting process. The first stage 70 lasts until time T, when the threshold temperature $T_{10}+T_a$ is reached by the thermocouple 40. During the second stage 72, the microwave power is pulsed as set out in the table above for a total time of $T_c$ which equals 32x. At time T, the remaining defrosting time $T_c$ is calculated by the microprocessor (74, FIG. 8) which displays the remaining time, counting down to zero, with attendant display of the corresponding power input level to the magnetron (76, FIG. 8). When the time has counted down to zero, marking the end of the second defrosting stage and the end of the defrosting process, the magnetron is de-energised, the fan 36 is de-energised, the turntable 14 is de-energised and the damper is opened, as indicated at 78 in FIG. 8. The end of defrosting is also indicated by reference numeral 78 in FIG. 7.

The described defrosting process is responsive to a small load (or to no load) because under these circumstances T will be very small, and therefore x and $T_c$ will be correspondingly small.

I claim:

1. A method of defrosting a frozen food item in a microwave oven, comprising the steps of:

placing the food item in a cavity of the oven;

recirculating air through said cavity throughout a defrosting period including first and second defrosting stages;

taking an initial ambient temperature sensing of said recirculating air;

introducing continuous microwave power into said cavity to heat the food item;

determining a threshold temperature, said steps of recirculating air, introducing continuous microwave power, and taking an initial ambient temperature sensing occurring substantially simultaneously to begin said first defrosting stage and said step of determining a threshold temperature occurring at a predetermined time after the beginning of said first defrosting stage;

monitoring the temperature of the recirculating air;

measuring elapsed time from beginning said first defrosting stage until the temperature of the recirculating air reaches said threshold temperature;

terminating said first defrosting stage when the temperature of the recirculating air reaches said threshold temperature;

calculating the duration of said second defrosting stage;

initiating said second defrosting stage, said second defrosting stage further comprising the steps of maintaining the continuous flow of recirculating air and introducing pulsed microwave power into said cavity; and terminating said defrosting period.

2. A method of defrosting a frozen food item in a microwave oven according to claim 1 wherein said step of determining a threshold temperature compensates for varying ambient temperature, the higher said initial ambient temperature the higher said threshold temperature.

3. A method of defrosting a frozen food item in a microwave oven according to claim 2, wherein said step of determining a threshold temperature further comprises the steps of noting the temperature of the recirculating air at a predetermined time after commencement of said first defrosting stage; and adding to the noted temperature a compensating temperature related to the initial ambient temperature of the recirculating air.

4. A method of defrosting a frozen food item in a microwave oven according to claim 3, wherein said step of taking said initial ambient temperature of the recirculating air is accomplished by means of a thermocouple arranged adjacent where the recirculating air enters said cavity, and said step of adding to the noted temperature a compensating temperature related to the initial ambient temperature of the recirculating air is performed by a microprocessor having stored therein a characteristic for deriving said compensating temperature from the initial ambient temperature of the recirculating air.

5. A method of defrosting a frozen food item in a microwave oven according to claim 1 wherein said step of monitoring the temperature of the recirculating air is accomplished by a temperature sensor positioned adjacent where the recirculating air leaves said cavity.

6. A method of defrosting a frozen food item in a microwave oven according to claim 1, further comprising the step of computing the duration of said second defrosting stage, means for computing the duration of said second defrosting stage being a microprocessor, said microprocessor using the time said threshold temperature is reached and an internally stored characteristic to compute the duration of said second defrosting stage.

7. A method of defrosting a frozen food item in a microwave oven according to claim 6 wherein said second defrosting stage is divided into alternating periods of no microwave power and predetermined magnitudes of microwave power in accordance with a preset program contained in said microprocessor, said preset program having a predetermined number of periods, each of said periods having a time duration which is a preset proportion of the total duration of said second defrosting stage.

8. A microwave oven for defrosting food items, comprising:

a cavity for receiving the food item;

means for recirculating air through said cavity throughout a defrosting period including first and second defrosting stages;

means for taking an initial ambient temperature sensing of said recirculating air;

means for introducing continuous microwave power into said cavity to heat the food item;

means for determining a threshold temperature, each of said means for recirculating air, introducing continuous microwave power, and taking an initial ambient temperature sensing being activated substantially simultaneously to begin said first defrosting stage and said means for determining a threshold temperature being activated at a predetermined time after the beginning of said first defrosting stage;

means for monitoring the temperature of the recirculating air;

means for measuring elapsed time from beginning said first defrosting stage until the temperature of the recirculating air reaches said threshold temperature;

means for terminating said first defrosting stage when the temperature of the recirculating air reaches said threshold temperature;

means for calculating the duration of said second defrosting stage;

means for initiating said second defrosting stage, said second defrosting stage further comprising means for maintaining the flow of recirculating air and means for introducing pulsed microwave power into said cavity; and means for terminating said defrosting period.

9. A microwave oven according to claim 8, wherein said threshold temperature compensates for varying ambient temperature, the higher said initial ambient temperature the higher threshold temperature.

10. A microwave oven according to claim 9, wherein said means for determining a threshold temperature further comprises means for noting the temperature of the recirculating air at a predetermined time after commencement of said first defrosting stage; and means for adding to the noted temperature a compensating temperature related to the initial ambient temperature of the recirculating air.

11. A microwave oven according to claim 10, wherein said means for taking said initial ambient temperature of the recirculating air is a thermocouple arranged adjacent where the recirculating air enters said cavity, and said means for adding to the noted temperature a compensating temperature related to the initial ambient temperature of the recirculating air comprise a microprocessor having stored therein a characteristic for deriving said compensating temperature from the initial ambient temperature of the recirculating air.

12. A microwave oven according to claim 8, wherein said means for monitoring the temperature of the recirculating air comprises a temperature sensor positioned adjacent where the recirculating air leaves said cavity.

13. A microwave oven according to claim 8, further comprising means for computing the duration of said second defrosting stage, said means for computing said duration of said second defrosting stage being a microprocessor, said microprocessor using the time said threshold temperature is reached and an internally stored characteristic to compute the duration of said second defrosting stage.

14. A microwave oven according to claim 13, wherein said second defrosting stage is divided into alternating periods of no microwave power and predetermined magnitudes of microwave power in accordance with a preset program contained in said microprocessor, said preset program having a predetermined number of periods each of said periods having a time duration which is a preset proportion of the total duration of said second defrosting stage.

* * * * *